United States Patent [19]

Tsubokawa

[11] Patent Number: 4,718,149

[45] Date of Patent: Jan. 12, 1988

[54] SLIDE FASTENER

[75] Inventor: Yoshitoki Tsubokawa, Kurobe, Japan

[73] Assignee: Yoshida Kogyo K.K., Tokyo, Japan

[21] Appl. No.: 894,453

[22] Filed: Aug. 4, 1986

Related U.S. Application Data

[63] Continuation of Ser. No. 606,201, May 2, 1984, abandoned.

[30] Foreign Application Priority Data

May 11, 1983 [JP] Japan ..... 58-70299[U]
Mar. 28, 1984 [JP] Japan ..... 59-45466[U]

[51] Int. Cl.[4] ..... A44B 19/02
[52] U.S. Cl. ..... 24/392; 24/396
[58] Field of Search ..... 24/391–398, 24/413, 414

[56] References Cited

U.S. PATENT DOCUMENTS

| | | | |
|---|---|---|---|
| 3,054,171 | 9/1962 | Ruhrmann et al. | 24/396 |
| 3,147,529 | 9/1964 | Wilcken | 24/396 |
| 3,820,202 | 6/1974 | Takamatsu | 24/393 |
| 4,022,034 | 5/1977 | Matsuda | 24/394 X |
| 4,133,084 | 1/1979 | Yoshida | 24/393 |
| 4,167,055 | 9/1979 | Molnar | 24/394 |
| 4,254,538 | 3/1981 | Lawrence | 24/391 |
| 4,276,679 | 7/1981 | Moertel | 24/413 |
| 4,276,680 | 7/1981 | Moertel | 24/397 X |
| 4,372,999 | 2/1983 | Satoo | 24/393 X |

*Primary Examiner*—Peter A. Aschenbrenner
*Attorney, Agent, or Firm*—Hill, Van Santen, Steadman & Simpson

[57] ABSTRACT

A slide fastener comprises a reinforcement strip fixed to at least one surface of each stringer tape of nonwoven sheet material along its one longitudinal edge to which a row of coupling elements is attached by sewing stitches. The stringer tape is made of thermoplastic synthetic resin, and the reinforcement strip comprises a film of thermoplastic synthetic resin fused with or otherwise bonded to the stringer tape so as to form a reinforced longitudinal edge of the stringer tape. The reinforced longitudinal edge has an increased mechanical strength for protection against forces tending to tear apart the stringer tape along the sewing stitches. The reinforcement strips jointly have a transverse width larger than the width of a slider to protect the stringer tape from being worn away due to frictional engagement with a slider during use of the slide fastener.

3 Claims, 13 Drawing Figures

SLIDE FASTENER

This is a continuation of application Ser. No. 606,201, filed May 2, 1984, now abandoned.

BACKGROUND OF THE INVENTION

1. Field of the Invention

The present invention relates generally to a slide fastener for use on a bag, for example, made of a nonwoven sheet material to open and close an opening therein, and more particularly to such a slide fastener having stringer tapes made of the same materials as the bag and carrying rows of coupling elements sewn to the inner longitudinal edges of the tapes.

2. Prior Art

Known slide fasteners for attachment to bags of nonwoven sheet material comprise stringer tapes made of a nonwoven sheet material and supporting rows of coupling elements sewn directly to their inner longitudinal edges thereof. Since the stringer tapes are perforated by the sewing needle, they become weak in mechanical strength. When such a slide fastener is subjected to transverse forces tending to pull the stringer tapes laterally apart, the stringer tapes are likely to be torn apart along their respective perforated longitudinal edges before the rows of coupling elements are disengaged from each other. Further, the stringer tapes of nonwoven sheet material are liable to be damaged due to frictional engagement with a slider during use of the slide fastener. Throughout the specification and the claims, the term "nonwoven sheet material" is used to refer to such a material as paper, nonwoven fabric, felt or thermoplastic synthetic resin film, but to exclude woven or knitted fabric.

SUMMARY OF THE INVENTION

It is, therefore, an object of the present invention to provide a slide fastener including a pair of stringer tapes of nonwoven sheet material each having a longitudinal edge portion which is reinforced and hence has an increased mechanical strength for protection against forces tending to tear apart the stringer tape along the longitudinal edge portion to which a row of coupling elements is stitched.

Another object of the present invention is to provide a slide fastener in which a pair of fastener stringer tapes having opposed inner longitudinal edge portions is reinforced to become resistant to abrasive wear caused by frictional engagement with a slider.

According to the present invention, a slide fastener comprises a stringer tape of nonwoven sheet material and a reinforcement strip fixed to at least one surface of the stringer tape along its one longitudinal edge to which a row of coupling elements is attached by sewing stitches. The reinforced longitudinal edge has an increased mechanical strength for protection against forces tending to tear apart the stringer tape along the sewing stitches. The stringer tape is made of paper, nonwoven fabric, felt or thermoplastic synthetic resin, and the reinforcement strip comprises a film of thermoplastic synthetic resin fused with or otherwise bonded to the stringer tape. The reinforcement strip may be a woven or knit fabric bonded to the stringer tape. The reinforcement strips jointly have a transverse width at least equal to the width of a slider so as to protect the stringer tape from damage or abrasive wear due to frictional engagement with the slider.

Many other advantages and features of the present invention will become manifest to those versed in the art upon making reference to the detailed description and the accompanying sheets of drawings in which preferred structural embodiments incorporating the principles of the present invention are shown by way of illustrative example.

BRIEF DESCRIPTION OF THE DRAWINGS

FIG. 4(*b*) is a view similar to FIG. 4(*a*) showing another modified slide fastener stringer;

DETAILED DESCRIPTION

Figure 1:
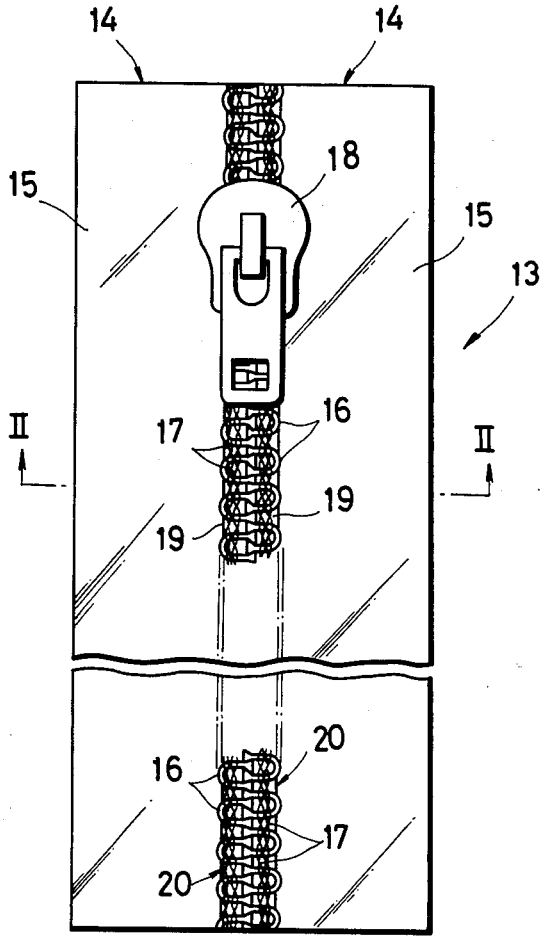
FIG. 1 is a fragmentary plan view of a slide fastener according to the present invention.

As shown in FIG. 1, a slide fastener 13 comprises a pair of slide fastener stringers 14, 14 each having a stringer tape 15 supporting a row of coupling elements 16 of zigzag or meandering type stitched by a pair of rows of sewing stitches 17 on and along one longitudinal edge of the stringer tape 15. The two rows of coupling elements 16 can be taken into and out of mutual engagement by a slider 18 manually movable along the rows of coupling elements 16.

Figure 2:
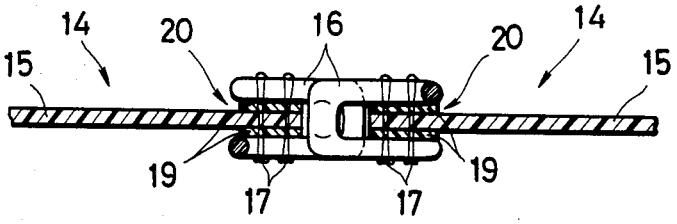
FIG. 2 is an enlarged fragmentary cross-sectional view taken along line II—II of FIG. 1.

As better shown in FIG. 2, each of the stringer tapes 15 is made of a thermoplastic synthetic resin such as vinyl chloride, polyester, nylon and the like. The stringer 14 further includes a pair of reinforcement strips 19 fixed on opposite surfaces of the stringer tape 15 along the longitudinal edge to form a reinforced longitudinal edge portion 20 of the stringer tape 15. The reinforcement strip 19 is made of the same material as the stringer tape 15, namely thermoplastic synthetic resin fused by ultrasonic energy with the stringer tape 15. Alternatively, the synthetic resin strips 19 may be bonded on the stringer tape 15. The row of zigzag coupling elements 16 is mounted on the reinforced longitudinal edge portion 20 and sewn thereto by the sewing stitches 17.

Figure 3:
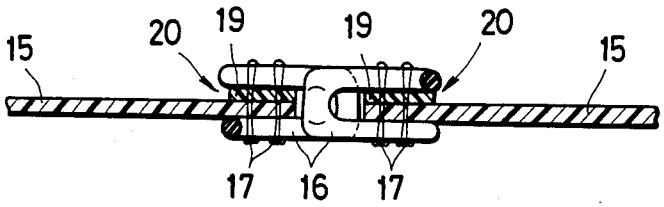
FIG. 3 is a view similar to FIG. 2, showing another embodiment.

The stringer tape 15 with such reinforced longitudinal edge portion 20 has an increased mechanical strength for protection against forces tending to tear apart the stringer tape 15 along the sewing stitches 17. One of such reinforcement strips 19 may be omitted as shown in FIG. 3.

Figure 4:
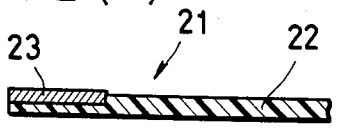
FIG. 4(*a*) is a fragmentary transverse cross-sectional view of a modified slide fastener stringer before being assembled with a row of coupling elements.
Figure 4:
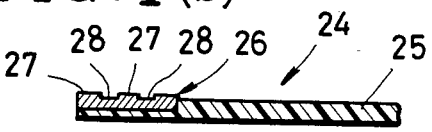

FIG. 4(*a*) illustrates a modification in which a slide fastener stringer 21 includes a stringer tape 22 extrusion-molded of thermoplastic synthetic resin and a reinforcement strip in the form of a woven fabric 23 which is partly embedded in one surface of the stringer tape 22 along one longitudinal edge thereof as the stringer tape 22 is continuously molded.

Figure 5:
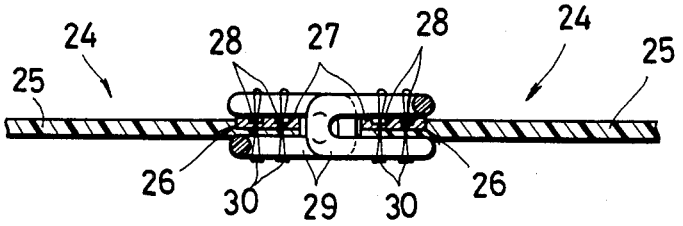
FIGS. 5 to 7 are views similar to FIG. 2, respectively, showing different modifications.

A modified slide fastener stringer 24 shown in FIG. 4(*b*) includes a stringer tape 25 extrusion-molded of thermoplastic synthetic resin and a reinforcement strip composed of a knitted fabric 26 partly embedded in one surface of the stringer tape 25 along one longitudinal edge thereof at the same time the stringer tape 25 is extrusion molded. The knitted fabric 26 has an exposed surface including a plurality (three being shown) of wales 27 and a plurality (two being shown) of interwale grooves 28 extending between adjacent wales 27. A row of zigzag coupling elements 29 is attached to the stringer tape 25 by a pair of rows of sewing stitches 30, as shown in FIG. 5. Each row of sewing stitches 30 extends in and along a corresponding one of the interwale grooves 28 in the reinforcement strip 26. With this arrangement, the coupling elements 29 are secured stably in position to the tape's longitudinal edge against lateral displacement with respect to the stringer tape 25. Further, the slide fastener stringer 24 becomes more resistant to forces tending to tear apart the stringer tape 25 along the rows of sewing stitches 30.

Figure 6:
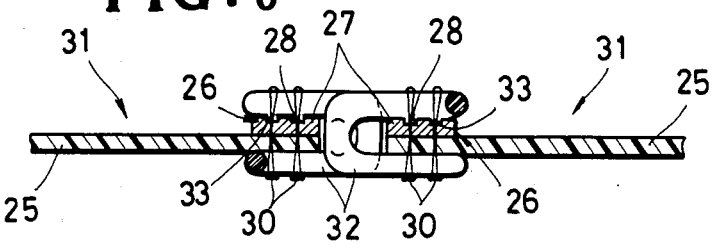

A slide fastener stringer 31 shown in FIG. 6 is substantially the same as the stringer 24 of FIG. 5 with the exception that each coupling element 32 has a pair of projections 33 receivable in the interwale grooves 28, respectively, in the knitted fabric 26. The coupling elements 32 can be secured to the stringer tape 25 more firmly and stably than the coupling elements 29 of FIG. 5.

Figure 7:
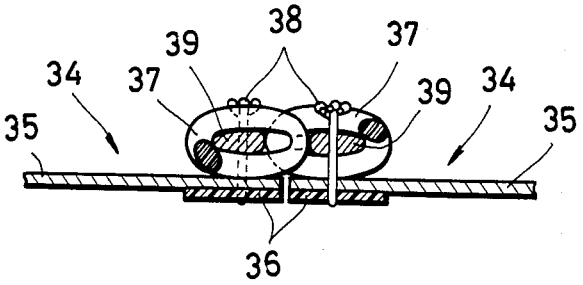

FIG. 7 shows a modification in which each stringer 34 has a stringer tape 35 of paper or nonwoven fabric, and a reinforcement strip 36 of thermoplastic synthetic resin fused or otherwise bonded on one surface of the stringer tape 35 along one longitudinal edge thereof to reinforce the latter. A row of coiled coupling elements 37 is disposed on the other surface of the stringer tape 35 and attached by sewing stitches 38 to the stringer tape 35 along the reinforced longitudinal edge, together with a core cord 39 extending longitudinally through the coiled coupling elements 37.

Figure 8:
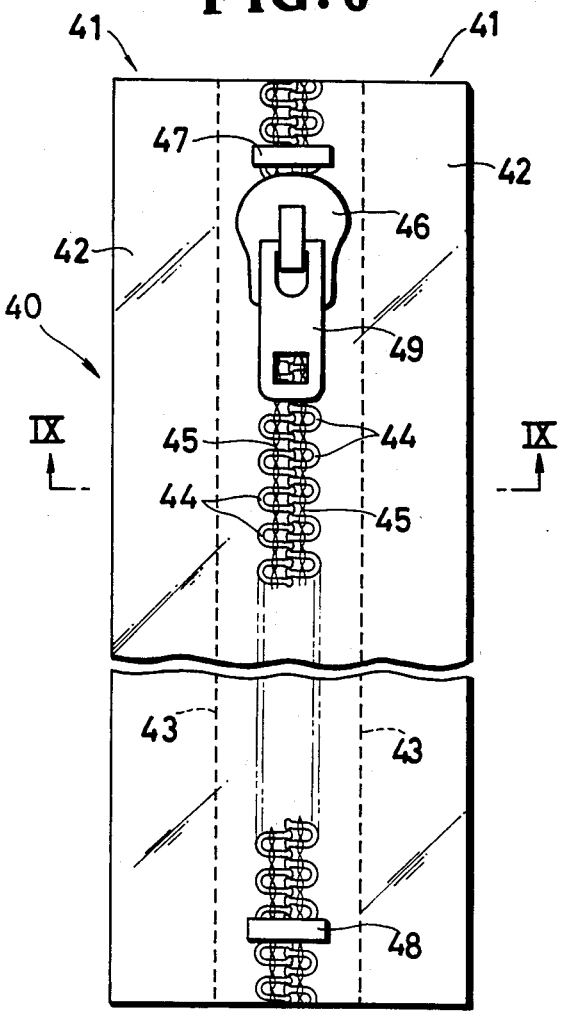
FIG. 8 is a fragmentary plan view of a slide fastener according to another embodiment.
Figure 9:
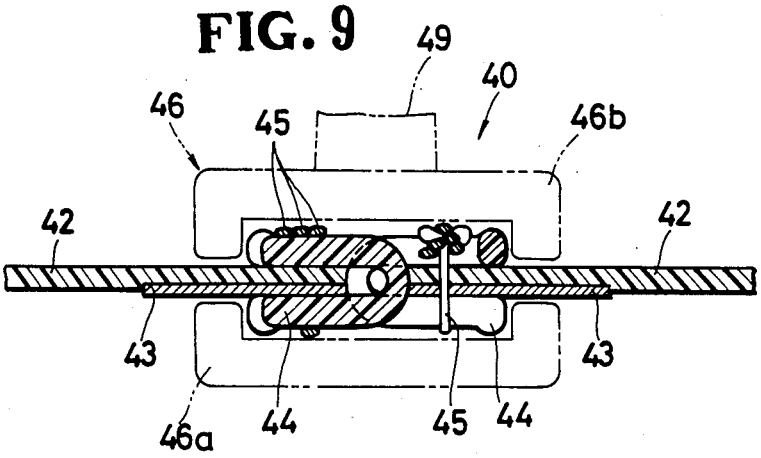
FIG. 9 is an enlarged fragmentary cross-sectional view taken along line IX—IX of FIG. 8.

According to a still further embodiment shown in FIGS. 8 and 9, a slide fastener 40 comprises a pair of slide fastener stringers 41, 41 each having a stringer tape 42 of thermoplastic synthetic resin, a reinforcement strip 43 of taffeta fused with or otherwise bonded on one surface or the underside of the stringer tape 42 along one longitudinal edge portion thereof, and a row of zigzag coupling elements 44 attached by a row of sewing stitches 45 on and along the longitudinal edge portion of the stringer tape 42. The two rows of coupling elements 44, 44 can be taken into and out of mutual engagement by a slider 46 manually movable along the rows of coupling elements 44. The slide fastener 40 also includes a pair of top and bottom stops 47, 48 for preventing the slider 46 from running off the rows of coupling elements 44 in fastener opening or closing movement therealong. The reinforcement strips 43, 43 jointly have a transverse width at least equal to the width of the slider 46 so that the longitudinal edge portions of the stringer tapes 42 becomes resistant to abrasive wear caused by frictional engagement with the slider 46.

Figure 12:
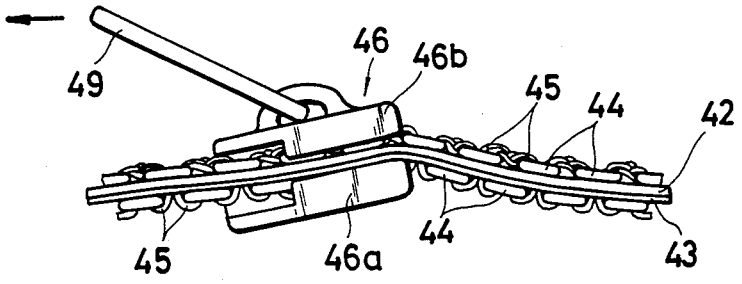
FIG. 12 is an enlarged fragmentary side elevational view of the slide fastener of FIG. 8, the view showing the slide fastener as being closed by a slider.

Experiments showed that the abrasive wear of the stringer tapes 42 was caused mostly by the rear edge of a lower wing 46*a* of the slider 46 which was urged against frictional engagement with the undersides of the respective stringer tapes 42 when the pull tab 49 was pulled to move the slider 46 in the slider-opening direction indicated by the arrow in FIG. 12. Likewise, movement of the slider 46 in the slider-opening direction caused the rear end of the slider's lower wing 46*a* to frictionally engage with the undersides of the respective stringer tapes 42. Accordingly, each of the reinforcement strips 43 preferably is fixed to one surface or the underside of each stringer tape 42 which faces away from an upper wing 46*b* of the slider 46 on which the pull tab 49 is pivotably supported.

Figure 10:
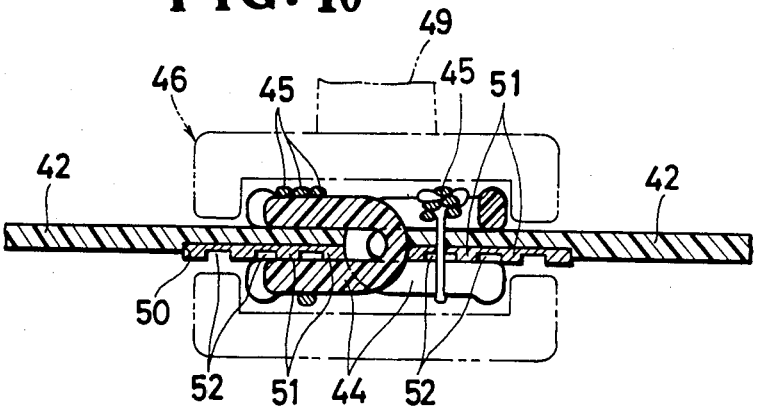
FIGS. 10 and 11 are views similar to FIG. 9, respectively showing different modifications.

As shown in FIG. 10, the reinforcement strip may be composed of a knitted fabric 50 fixed to the underside of each stringer tape 42 along the longitudinal edge portion thereof. The knitted fabric 50 has an exposed surface including a plurality of wales 51 and a plurality of interwale grooves 52 defined between adjacent wales 51. The row of sewing stitches 45 extends in and along one of the interwale grooves 52 for stable attachment of the row of zigzag coupling elements 44 to the stringer tape 42. The knitted fabrics 50, 50 jointly have a transverse width larger than the width of the slider 46 for protecting the stringer tapes 42 from abrasive wear.

Figure 11:
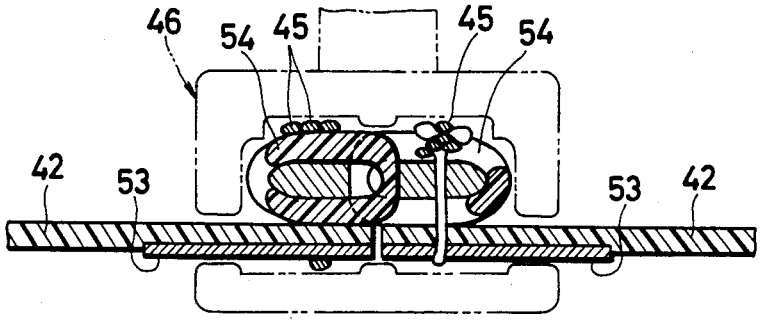

FIG. 11 shows a modification in which a reinforcement strip 53 composed of a taffeta is fixed to one surface or the underside of each stringer tape 42 along an inner longitudinal edge portion thereof. A row of coiled coupling elements 54 is disposed on the opposite surface of the stringer tape 42 along the inner longitudinal edge and is sewn thereto by means of a row of sewing stitches 45. The reinforcement fabrics 53, 53 jointly have a transverse width larger than the width of the slider 46 for protection against abrasive wear tending to damage the stringer tapes 42.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. A slide fastener comprising:

(a) a pair of non-woven stringer tapes, each stringer tape being made of a single layer of unfolded non-woven sheet material and having an unfolded inner longitudinal edge portion;

(b) a pair of fabric reinforcement strips each being a web of fabric material and being bonded to one exposed surface of each of said pair of stringer tapes along said unfolded longitudinal edge portion to form a fabric reinforced unfolded longitudinal edge portion;

(c) a pair of rows of coupling elements each attached respectively by at least a pair of rows of sewing stitches to said stringer tapes along said fabric reinforced unfolded longitudinal edge portions;

(d) a slider slidably movable along said rows of coupling elements for taking said rows of coupling elements into and out of mutual engagement with one another, said slider having a pair of wings disposed one on each side of said stringer tapes;

(e) a pull tab pivotably supported on one of said wings, and (f) said fabric reinforcement strips being exclusively disposed on the surfaces of said pair of stringer tapes which surfaces face away from said one wing of the slider on which said pull tab is supported, and said fabric reinforcement strips having a combined transverse width greater than the width of said slider and being frictionally engagable with the other wing of the slider while said slider is in motion to protect said non-woven stringer tapes against abrasive wear.

2. A slide fastener according to claim 1, wherein the fabric material comprises a taffeta.

3. A slide fastener according to claim 1, wherein said fabric material comprises a knit fabric.

* * * * *